US008348749B1

(12) United States Patent
Ungaro et al.

(10) Patent No.: US 8,348,749 B1
(45) Date of Patent: Jan. 8, 2013

(54) MULTIPLE PROGRESSIVE GAMING TABLE APPARATUS

(76) Inventors: Mark Curran Ungaro, Las Vegas, NV (US); Christopher John Nichols, Las Vegas, NV (US)

( * ) Notice: Subject to any disclaimer, the term of this patent is extended or adjusted under 35 U.S.C. 154(b) by 962 days.

(21) Appl. No.: 11/800,075

(22) Filed: May 4, 2007

(51) Int. Cl.
*A63F 9/24* (2006.01)

(52) U.S. Cl. ..... 463/25; 463/30

(58) Field of Classification Search ..... 463/20–37, 463/40–43; 273/292, 138.1, 143 R
See application file for complete search history.

(56) References Cited

U.S. PATENT DOCUMENTS

| | | | | |
|---|---|---|---|---|
| 4,861,041 | A * | 8/1989 | Jones et al. | 273/292 |
| 5,078,405 | A * | 1/1992 | Jones et al. | 463/27 |
| 5,288,081 | A * | 2/1994 | Breeding | 273/292 |
| 6,217,448 | B1 * | 4/2001 | Olsen | 463/25 |
| 6,299,534 | B1 * | 10/2001 | Breeding et al. | 463/25 |
| 6,656,048 | B2 * | 12/2003 | Olsen | 463/25 |
| 6,811,153 | B1 * | 11/2004 | Ko | 273/292 |
| 7,059,602 | B2 * | 6/2006 | Grauzer et al. | 273/149 R |
| 7,407,438 | B2 * | 8/2008 | Schubert et al. | 463/22 |
| 7,677,565 | B2 * | 3/2010 | Grauzer et al. | 273/149 R |
| 7,822,641 | B2 * | 10/2010 | Abbott et al. | 705/25 |
| 7,896,741 | B2 * | 3/2011 | Kuehling et al. | 463/29 |
| 2001/0004607 | A1 * | 6/2001 | Olsen | 463/26 |
| 2004/0102243 | A1 * | 5/2004 | Olsen | 463/25 |
| 2005/0062226 | A1 * | 3/2005 | Schubert et al. | 273/149 R |
| 2005/0239542 | A1 * | 10/2005 | Olsen | 463/27 |
| 2006/0281537 | A1 * | 12/2006 | Abbott et al. | 463/25 |
| 2007/0111786 | A1 * | 5/2007 | Snow | 463/27 |
| 2007/0117604 | A1 * | 5/2007 | Hill | 463/16 |
| 2008/0248855 | A1 * | 10/2008 | Kamano | 463/20 |

* cited by examiner

*Primary Examiner* — Masud Ahmed

(57) ABSTRACT

A device that incorporates a random number generator that is to industry standards and can be configured and used for card games or electronic slot devices adding extra bonus betting that is electronically set to accept a wager on any hand of Poker, Blackjack, Pontoon, Craps, Roulette, Baccarat, Mini Baccarat, Stud Poker, Pai Gow, Pai Gow Poker, Spanish 21, Caribbean Stud Poker, Let It Ride, Three Card Poker, Draw Poker, Community Card Poker. This device is an extra-added bonus payout system coupled to any casino game existing on any casino floor. This device is also used for accumulated giveaways hooked to electronic displays and sports betting by accumulating a percent of the amount wagered and allowing the player's who are in on the jackpot to share in the jackpot with other players. This device is also used for separate betting functions by players to win a major jackpot individually and separately from existing bonus payout games on a casino gaming floor.

2 Claims, 7 Drawing Sheets

MULTIPLE PROGRESSIVE GAMING TABLE APPARATUS

BACKGROUND OF THE INVENTION

Thirty percent of the live casino games used in gaming are made up of some form of bonus betting. Most of these games are card games or games facilitated by a dealer. The dealer manages these games by dealing the cards to the players and paying out a bonus using a prescribed bonus schedule. Some of the live games are complicated, and some games are simple and direct. For example, Blackjack is a game that is the most popular with players. Other games include a bonus payout system. Examples of these games can be Pai Gow Poker, Caribbean Stud, Let Ride, Three Card Poker, and many others. Each individual game has it's own bonus feature.

Jones, et al. (U.S. Pat. No. 5,078,405) discloses a method and apparatus for including a progressive jackpot component in a live casino table game. In addition to playing a live casino table game, each player makes an additional wager at the beginning of each hand that makes that player eligible to win all of part of a jackpot. If during the play of the hand, a player is dealt a predetermined arrangement of cards, the player wins a pre-selected percentage of the jackpot amount.

Ko (U.S. Pat. No. 6,811,153) discloses a method of a game of Pai Gow tiles or in Three-Card Poker where all players compete against the dealer on the base wager. If the dealer receives one of predetermined hand combinations, a player making the optional proposition wager is paid odds on the proposition wager.

Breeding (U.S. Pat. No. 5,288,081) describes a playing card wagering game method, which involves each player placing a three-part bet. Cards are dealt by the dealer, two face down to the dealer and three face down to each player. Players inspect their cards and the dealer gives each player the choice of withdrawing or leaving a first part of the bet. Each player decides and the dealer then turns over one of the cards and again gives each player the choice of withdrawing or leaving the second part of the bet. The players decide, their cards are shown, and all remaining bets, which were not withdrawn, are resolved.

Jones et. al. (U.S. Pat. No. 4,861,041) again, describes a method and apparatus for including a progressive jackpot component in a live casino table game. In addition to playing a live casino table game, each player makes an additional wager at the beginning of each hand that makes that player eligible to win all of part of a jackpot. If during the play of the hand a player is dealt a predetermined arrangement of cards, the player wins a pre-selected percentage of the jackpot amount.

SUMMARY OF THE INVENTION

The present invention relates to card rooms and casino live gaming more particularly to gaming tables located on a casino floor including games of chance. This present invention will accommodate any live casino card game whether or not the card game has a bonus feature. The present invention can also be used in electronic gaming applications including but not limited to slot machines, sports betting, video poker machines, Asian Stud, Baccarat, Mini Baccarat, Chinese Poker, Faro, Four Card Poker, Let It Ride, Mambo Stud, Pai Gow Poker, Red Dog, Spanish 21, Texas Hold'em Bonus Poker, Three Card Poker, Two-up, Craps, Pai Gow, The Big Six Wheel, Roulette and Sic Bo.

By using this device with it's random number generator application, all winning hands and payoff amounts are merely preferred and the invention may be practiced using any appropriate combination of winning hands and payoff amounts.

The object of this invention is not to infringe upon any other patented application used for gaming on live gaming tables or machines. This invention picks the player's hand and not the game itself in making a bonus wager for the other players on a live game or machine. By using this device, all players have a chance at winning a bonus payout no matter what position the winning hand or result is dealt to.

DETAILED DESCRIPTION OF THE PREFERRED EMBODIMENTS

Live card games with bonus betting features used in casino are set to accept wagers from players and facilitated by a dealer who regulates and deals the cards to the player or plural of players. Most card games used today in a live casino environment have some form of a bonus-betting feature. Examples of these games can be Pai Gow Poker, Caribbean Stud, Let Ride, Three Card Poker, and many others. Each individual game has it's own bonus feature. Therefore, most casino establishments need to set up special space for these types of games to accommodate the player. The present device is used to accommodate all types of gaming in all forms. The random number generator device 10 is built and installed into a special design gaming table 14 that accepts all forms of standard table games.

Figure 1:
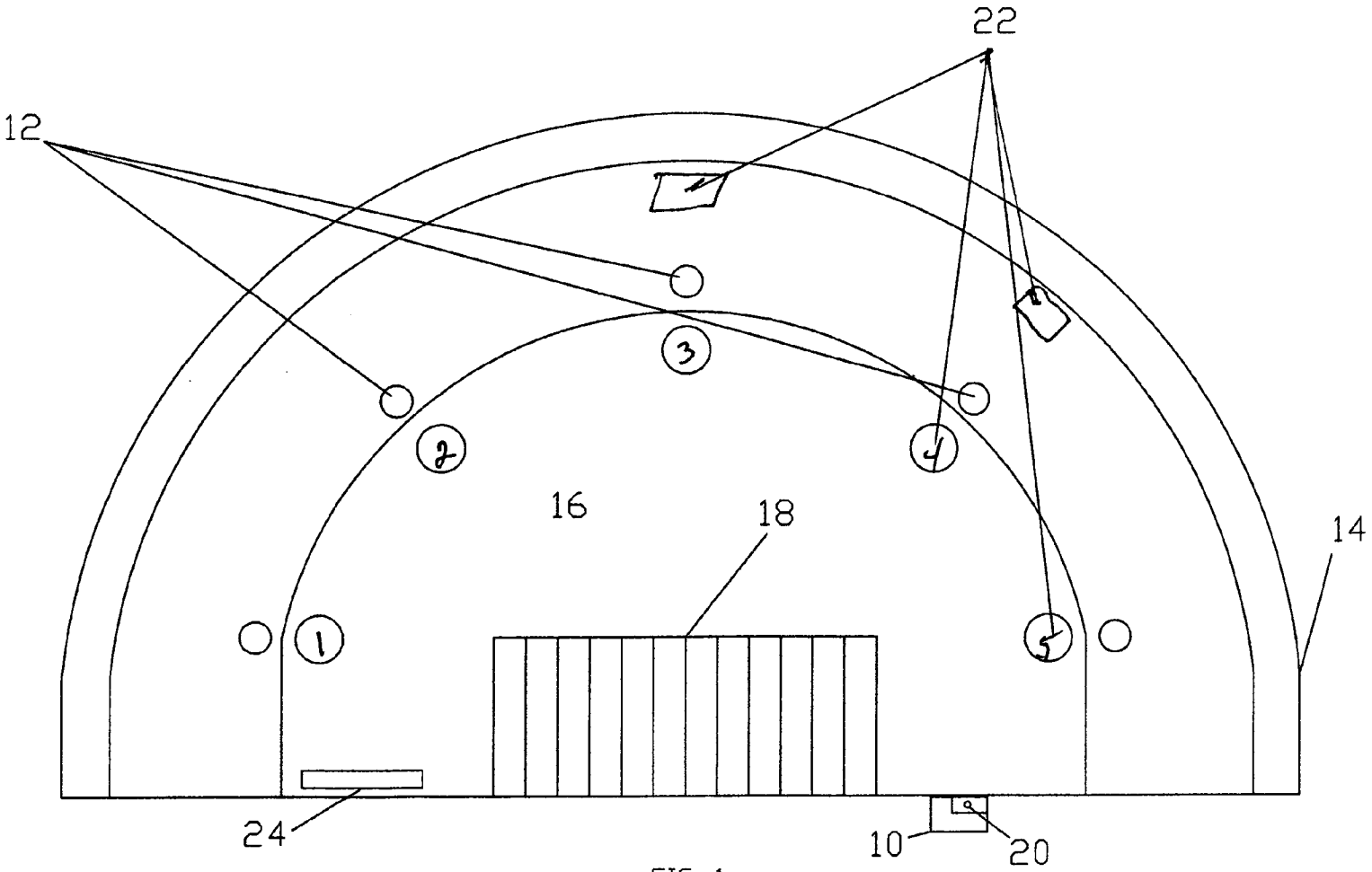
FIG. 1. is a top view of a typical casino gaming table with a chip rack
Figure 2:
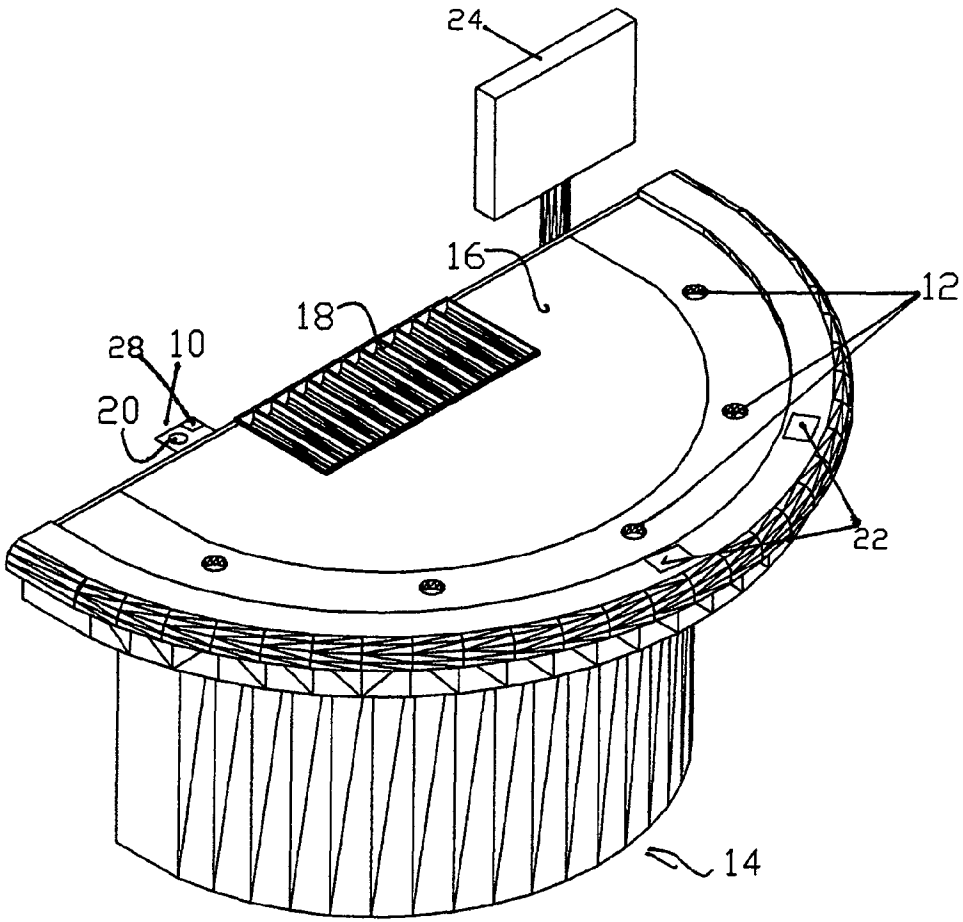
FIG. 2. is an isometric view of a typical gaming table that can accommodate any standard game-playing surface with the betting positions provided for the player to place an extra bonus wager.

In this embodiment we will use a Blackjack table design as described in FIG. 1. and FIG. 2. The device table 14 depicts a standard Blackjack table. The playing surface 16 is a standard felt designed with all indicia resembling a Blackjack table. The player stations 22 denoted by the sensors 12 located strategically around the table 14 indicating where the players will sit at the table. The chip rack 18 located in front of the dealer holds all chips needed to make all payouts for the game of Blackjack. If for example, the house would like to make this Blackjack game a bonus Blackjack game, management would simply turn on the bonus game. The bonus game could be "Three of a Kind". Players would place their wagers on the betting sensors 12 and the dealer would accept their wagers by pressing the accept button 20 located next to the chip rack 18 and the bonus wager would be the same amount wagered by all players who want to win an extra bonus payout. The RNG will now randomly bounce from player to player until the timer in the RNG stops at a player location. Lets say that location is player position three. This will be the hand that all players will have their wager placed upon. The dealer would simply deal the cards, and player three received two "Kings" and the dealer has a "King" also for his hand. All players who are in on the bonus wager of "Three of a Kind" will be paid an extra bonus payoff divided evenly among the players and rounded to the nearest dollar that were in on the particular hand that is set by the house or a standard bonus payout schedule.

Figure 3:
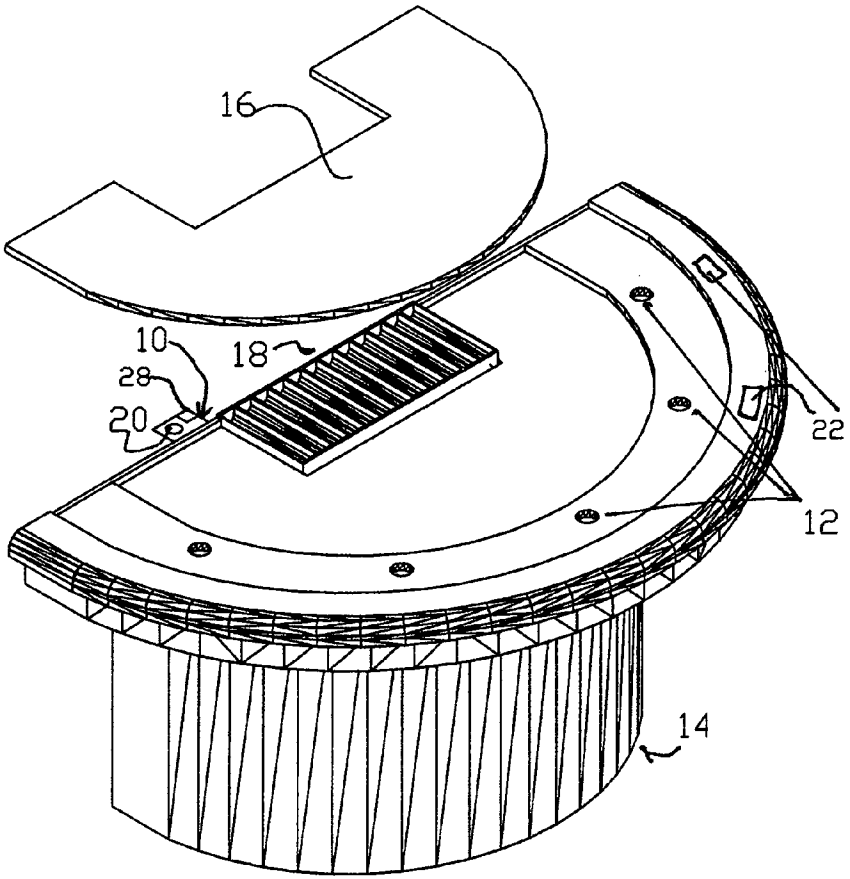
FIG. 3. is an isometric view of a typical gaming table depicting the playing surface being inserted into the table gaming device.

The next preferred embodiment for this invention could be a Pai Gow Poker game with a standard bonus payout schedule. Referring to FIG. 3 the Pai Gow Poker game 16 is inserted into the table 14 and the Pai Gow poker game is an already a patented game and the casino wants to add an extra-added bonus payout to the table itself and not the game. The device simply piggybacks to the existing game of Pai Gow Poker that uses a standard deck of 52 cards and a joker as an extra "Ace". The same principal of this device 10 applies to this game also. Should the players want to wager an extra-added bonus to their bet, they simply bet the sensor 12 located directly in front of their position 22. This Pai Gow Poker game has a bonus schedule for example that has: ("Four of a Kind" paying $5.00 "Straight Flush" paying $15.00 "Wild Royal" paying $50.00 "Royal Flush" paying $250.00 and "5 Aces" paying $1000.00). If the players want to bet the extra-added bonus from the table 14, they simply place a standard wager on the sensor 12. The dealer would again, press the accept button 20 and start the RNG in motion. The sensors will start flashing while the RNG is picking a player position to stop at. The RNG stopped at position one. This is the hand that the players that placed a wager on the sensor 12 will be betting on. Now, this hand is a winning hand with "5Aces" and there were four players in on the hand. The dealer would enter the hand in the key pad 28 and the display 24 would show the amount paid out in total. The player who was betting the hand in the first place would win the $1000.00 Pai Gow Bonus payout and the other three players who were in on his hand would also win $250.00 dollars a piece and the player who's hand that was acted upon would also win $250.00 dollars extra if he was in on the bonus sensor bet to begin with.

Figure 5:
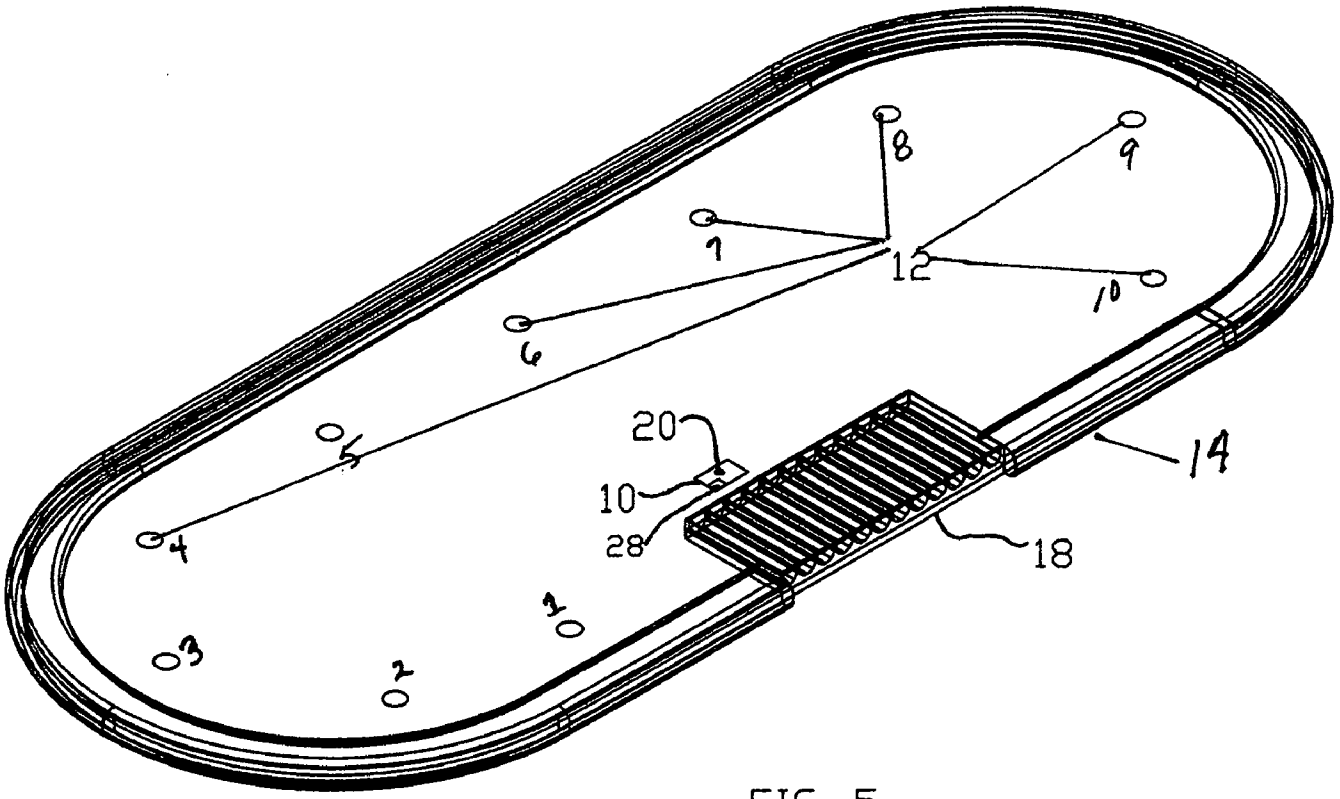
FIG. 5. is an isometric view of a standard Stud Poker Table with the sensors indicating the player positions.
Figure 6:
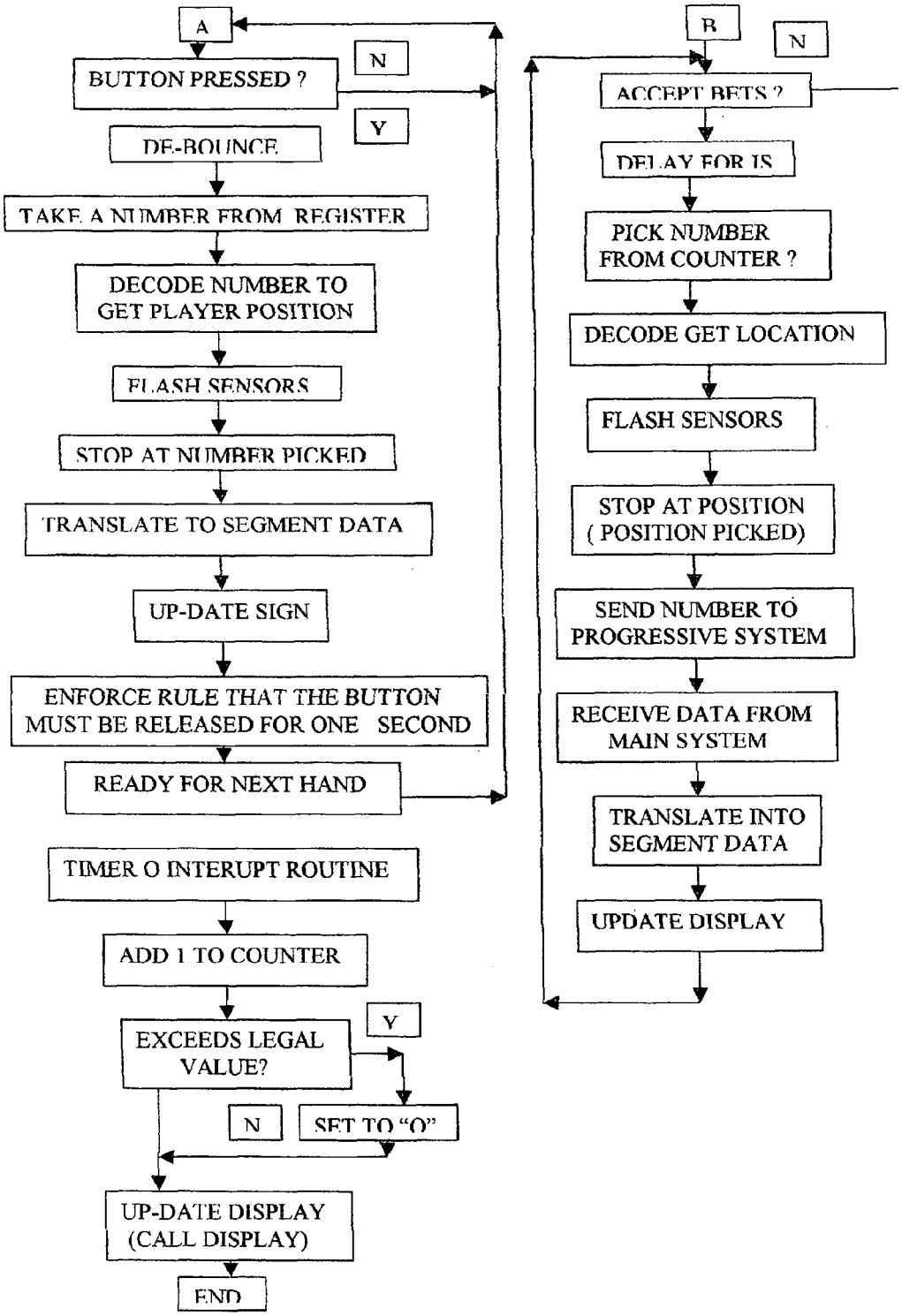
FIG. 6 is a flow chart for the device
Figure 7:
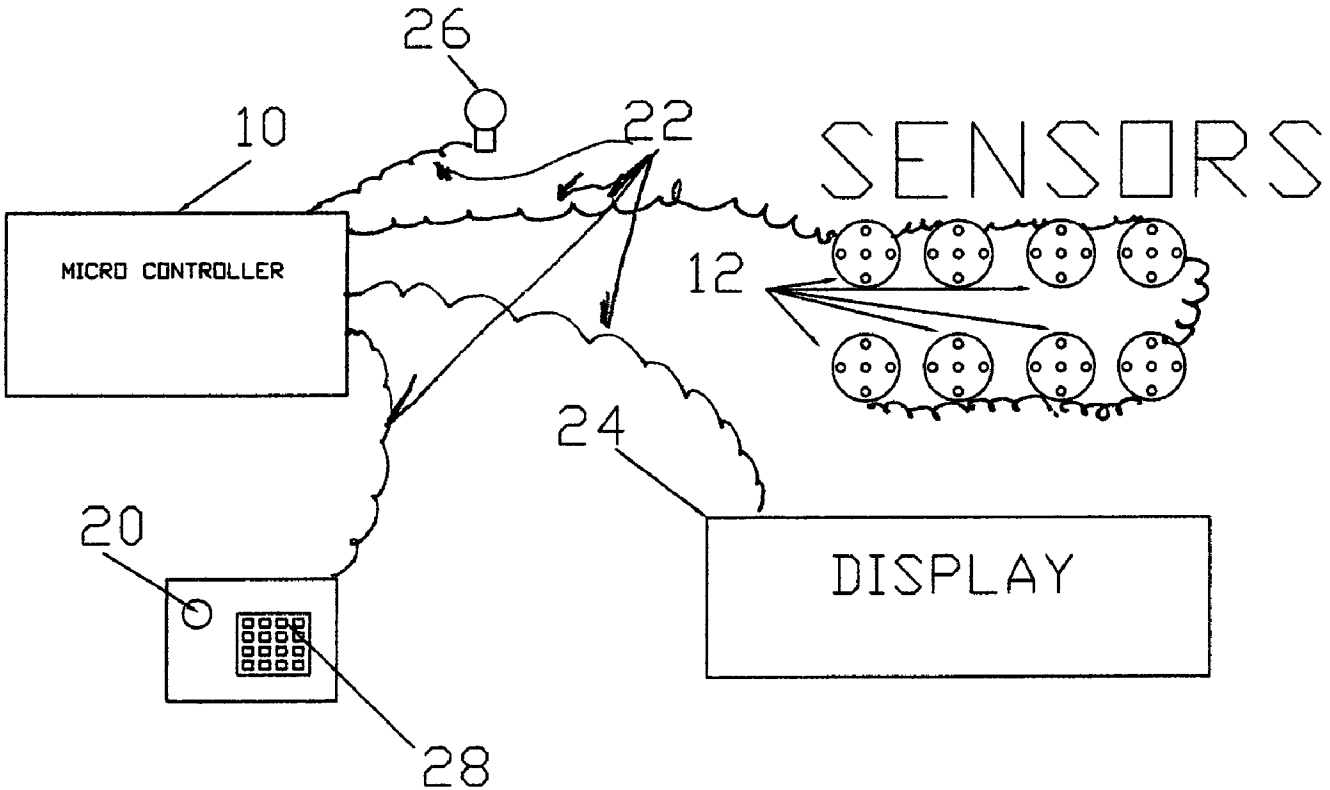
FIG. 7. is a simple configuration of the device

The next preferred embodiment for this invention referring to FIG. 5. is a "Stud Poker Game", the sensors 12 are positioned around the devise table 14, and this game has a posted "Bonus Payout Schedule": ("Four of a Kind" paying $5.00 "Straight Flush" paying $15.00 "Wild Royal" paying $50.00 "Royal Flush" paying $250.00 and "5 Aces" paying $1000.00). Note: (The "Bonus Payout Schedule" can be any schedule that the house deems fit.) The players who would like to bet a bonus and catch a few extra dollars would place a wager on the sensor 12 located directly in front of the position. The dealer would accept the bets by pressing the accept button 20 located at his position and this would start the RNG in the device 10 and the sensors 12 start flashing indiscriminately around the table and stopping on position six. This is the hand that all players are betting on for the extra-added bonus feature. This bonus could be a progressive bonus payout. As the hand is played out, and all the right cards are caught by player six, and the hand is won by player six, every player that bet the sensor 12 will win a evenly divided progressive payout. Player six, will not only win his personal hand of poker but a portion of the bonus payout if he bet the sensor.

Figure 4:
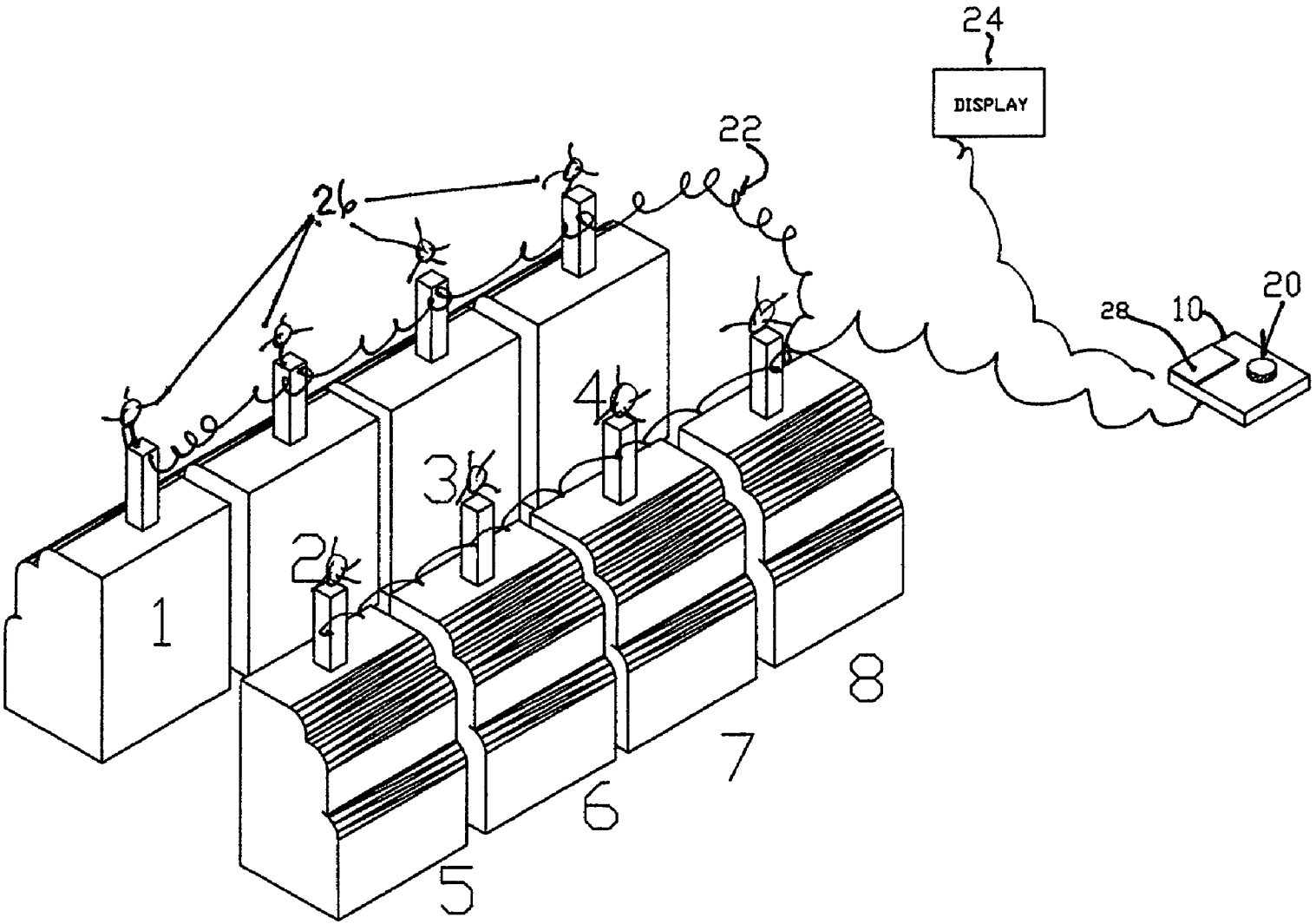
FIG. 4. is a electronic video set-up of the device used in slot machines or Video Poker machines.

To further explore the embodiment of the device refer to FIG. 4. With the present invention, the house can have what is called spot drawings for people who play electronic devices in the casino gaming atmosphere. Every machine located on the casino floor can be coupled to this device 10. A light 26, bell or whistle can be placed on top of every machine. The machine is coupled to the device 10 internally by a wire harness 22. The device will sense that there is play on that machine and now the house can have a drawing. The drawing is at three o'clock in the afternoon. Management will press the button 20 on the device 10 and the lights 26 will start racing thru the casino floor and stop on machine 7. The player that is playing on that particular machine will win either a jackpot or a dollar amount depending on house preference. The display 24 will register what machine won the prize and the bells and whistles will go off at machine 7. This will add more excitement to the players who are in the casino at the time of the drawing or bonus payoff.

The present invention is to provide a simple and precise addition to any existing game and add more excitement for the player. The apparatus 10 is made up of one to whatever (depending on the management) specially designed player station sensors using a P87C51 programmable chip, one microcontroller, and using five timed random number generators coupled together and then coupled to the micro controller and sign 24 depicting the jackpot amount. Built into the table 14 are the Ambient Light Photo sensors 12 for sensing the chip or token placement for the bonus jackpot. The wagering sensors have the capability to be adjusted for light depending on the ambient light source. The jackpot fund is accumulated solely from wagers made on the progressive portion of the game not the betting layout. The device itself, can either be played with a standard set of rules or the bonus variation or a set jackpot. The end result or outcome will always be the same for the player. Using the standards of the industry distinction, the dealer will manually enter the winning card combinations or winning numbers on the key pad for live table games.

We claim:

1. An apparatus for placing a separate bet in addition to the wager on the existing game on a live casino table game, comprising:

a. inserting a device into a standard aperture on an existing gaming table at each player position, said device comprising:

1. a programmable micro controller incorporating:

i. at least one random number generator, ii. an ambient light photosensor, iii. a wager detecting sensor, 2. a plurality of LED lights affixed around an electronic ambient light photosensor; and, 3. at least one flashing light sensor, b. situating an accept button on said existing gaming surface within the control of casino personnel;

c. placing one said wager detecting sensor device at each indicated player position of said existing live casino table game;

d. coupling said random number generator to each player station on said existing live casino table game to one micro controller;

e. locating a display sign on each said existing live casino table game;

f. conveying information detected from said player position sensor through said programmable micro controller to said display sign;

g. conveying amount of payout from said player position sensor through said programmable micro controller wager detector sensor to said display sign, wherein upon pressing said accept button by a dealer, a player placing said separate, additional wager on said sensor on said existing live casino table game may be randomly selected to win said separate, additional wager.

2. A device for placing an additional wager for a chance to win an additional payout on an existing electronic video slot machine casino game, comprising:

a. said device configured to be embedded in an existing electronic video slot machine game, comprising:

1. a programmable micro controller incorporating:

i. at least one random number generator, ii. a wager detecting sensor;

iii. a wire harness coupling said device embedded in existing video slot machine games to all said electronic machines;

2. at least one flashing light; and, 3. at least one display sign, b. situating an accept button for said existing electronic video slot machines within the control of casino management;

c. coupling said device random number generator located in each said electronic video slot machine to one said micro controller;

d. conveying information from said device through said programmable micro controller to said display sign, e. registering which said electronic video slot machine won a prize on said display sign; whereby upon pressing said accept button by casino management, a player placing said separate, additional wager at said wager detecting sensor on said existing electronic video slot machine may be randomly selected to win a separate payout for said separate, additional wager.

* * * * *